United States Patent [19]

Fujiura

[11] Patent Number: 4,838,808

[45] Date of Patent: Jun. 13, 1989

[54] SHIELDED ELECTRICAL CONNECTOR AND LATCH MECHANISM THEREFOR

[75] Inventor: Yoshitsugu Fujiura, Tokyo, Japan

[73] Assignee: AMP Incorporated, Harrisburg, Pa.

[21] Appl. No.: 208,621

[22] Filed: Jun. 15, 1988

[30] Foreign Application Priority Data

Jul. 17, 1987 [JP] Japan ..... 62-178823

[51] Int. Cl.[4] ..... H01R 13/627; H01R 13/648; H01R 13/629

[52] U.S. Cl. ..... 439/357; 439/347; 439/372; 439/610

[58] Field of Search ..... 439/345, 350, 357, 358, 439/372, 594, 609, 610, 347, 355, 352, 353

[56] References Cited

U.S. PATENT DOCUMENTS

| | | | |
|---|---|---|---|
| 3,603,910 | 9/1971 | Schumacher | 439/160 |
| 3,711,816 | 1/1973 | Schumacher | 439/352 |
| 4,337,989 | 7/1982 | Asick et al. | 439/609 |
| 4,367,003 | 1/1983 | Frantz | 439/347 |
| 4,514,029 | 4/1985 | Lax et al. | 439/610 |
| 4,568,135 | 2/1986 | Frantz | 439/350 |
| 4,582,378 | 4/1986 | Fruchard | 439/157 |
| 4,679,319 | 7/1987 | Grabbe et al. | 29/843 |

*Primary Examiner*—Eugene F. Desmond
*Assistant Examiner*—Stephen Zagrobelny
*Attorney, Agent, or Firm*—Adrian J. LaRue; William B. Noll; Bruce J. Wolstoncroft

[57] ABSTRACT

An electrical connector comprises a dielectric housing (3) having an electrical contact assembly (7) as part of a connecting section (2) for electrical connection with a complementary electrical connector. Latch members (4, 4') are mounted in the housing (3) and extend along respective sides of the connecting section (2) and include latch sections (4*c*, 4'*c*) and engaging sections (4*a*, 4'*a*). Planar arms (4*b*, 4'*b*) of the latch members (4, 4') are fixedly mounted in grooves (11, 11') of the housing (3) enabling the latch members to move from a latch position to a release position and operating means (5) is mounted in the housing (3) for movement from a first position to a second position by a force being applied thereto and including means (5*b*, 5*c*) engagable with the engaging sections (4*a*, 4'*a*) of the latch members (4, 4') for simultaneously moving the latch members from the latch position to the release position.

7 Claims, 3 Drawing Sheets

SHIELDED ELECTRICAL CONNECTOR AND LATCH MECHANISM THEREFOR

FIELD OF THE INVENTION

The present invention relates to a shielded electrical connector which electrically connects circuits or machines and which is constructed so that the connected sections of the electrical connectors are shielded. It also refers to an improved shielded connector having a latching mechanism which keeps the connectors connected together.

BACKGROUND OF THE INVENTION

Electrical connectors are used to electrically connect or disconnect circuits or machines. Shielded connectors are used to shield the connecting parts when connected in order to isolate the signal contacts from outside interference.

Bolts have traditionally been used as a means of maintaining the connectors in engagement. This has been troublesome when connecting and disconnecting the connectors because of having to install or remove the bolts. In addition, the connector is made larger to receive the bolts.

A connector disclosed in Japanese Application No. 61-296525 includes latch members that are moved from a latching position to an unlatched position by pressing sections of the latch members thereby enabling the latched connectors to be disconnected. In order to operate the latching members to disconnect the connectors, they have to be operated simultaneously. If one latch member is operated properly whereas the other is not, it can be damaged when the connectors are attempted to be disconnected.

SUMMARY OF THE INVENTION

The object of the present invention is to provide a shielded connector which includes a latching mechanism that securely latches to a complementary connector, the latch members can easily be unlatched from the complementary connectors and the latching members are operated simultaneously to ensure that neither of the latching members operates independently of the other so as not to cause any operating failures described above.

The shielded connector of the present invention has the following features: A protruding connecting section is connected to a complementary connector at one end of a housing. It has a pair of latch members which are easily latched to and unlatched from the connector and they extend along respective sides of the connecting section. It includes an operating member for moving the pair of latch members to one position to enable the connector to be connected to or disconnected from the complementary connector and to another position latching the connectors together. The latch members automatically move to a latch position when the operating member is released.

The operating member is a slidable member mounted in a dielectric housing and includes a projection exposed in an opening in the housing and leg sections engagable with latch members mounted in the housing so that movement of the operating member from a first position to a second position moves the latch members from a latched position to an unlatched position. In this way, the operating member by sliding movement in the housing between the latched position and the unlatched position operates the latch members simultaneously and not independently. Moreover, when the leg sections are in the first position, they maintain the latch members in the latch position. In addition, when the operating member is released, the spring force generated by the latch members being moved to the unlatched position will automatically move the operating member to the second position as a result of the latch members moving to the latch position.

BRIEF DESCRIPTION OF THE DRAWINGS

The invention, together with objects and advantages thereof, is best understood by way of example with reference to the following detailed description in conjunction with the accompanying drawings.

DETAILED DESCRIPTION OF THE INVENTION

Figure 1:
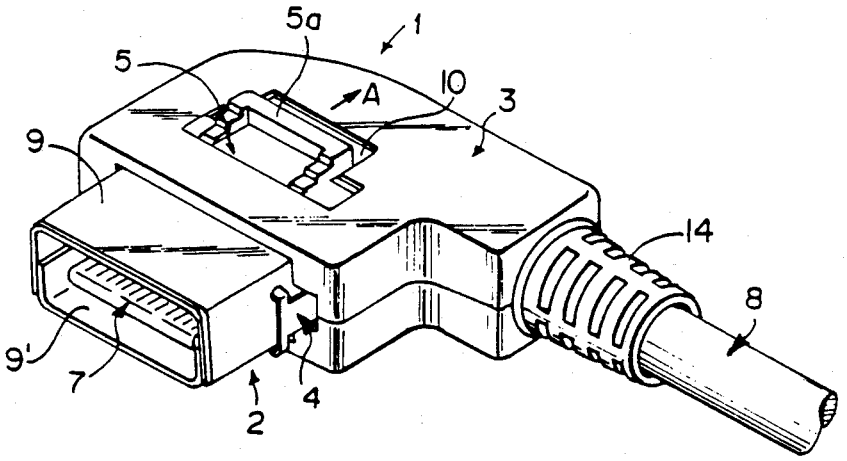
FIG. 1 is a perspective view of a shielded electrical connector including the latching mechanism.
Figure 2:
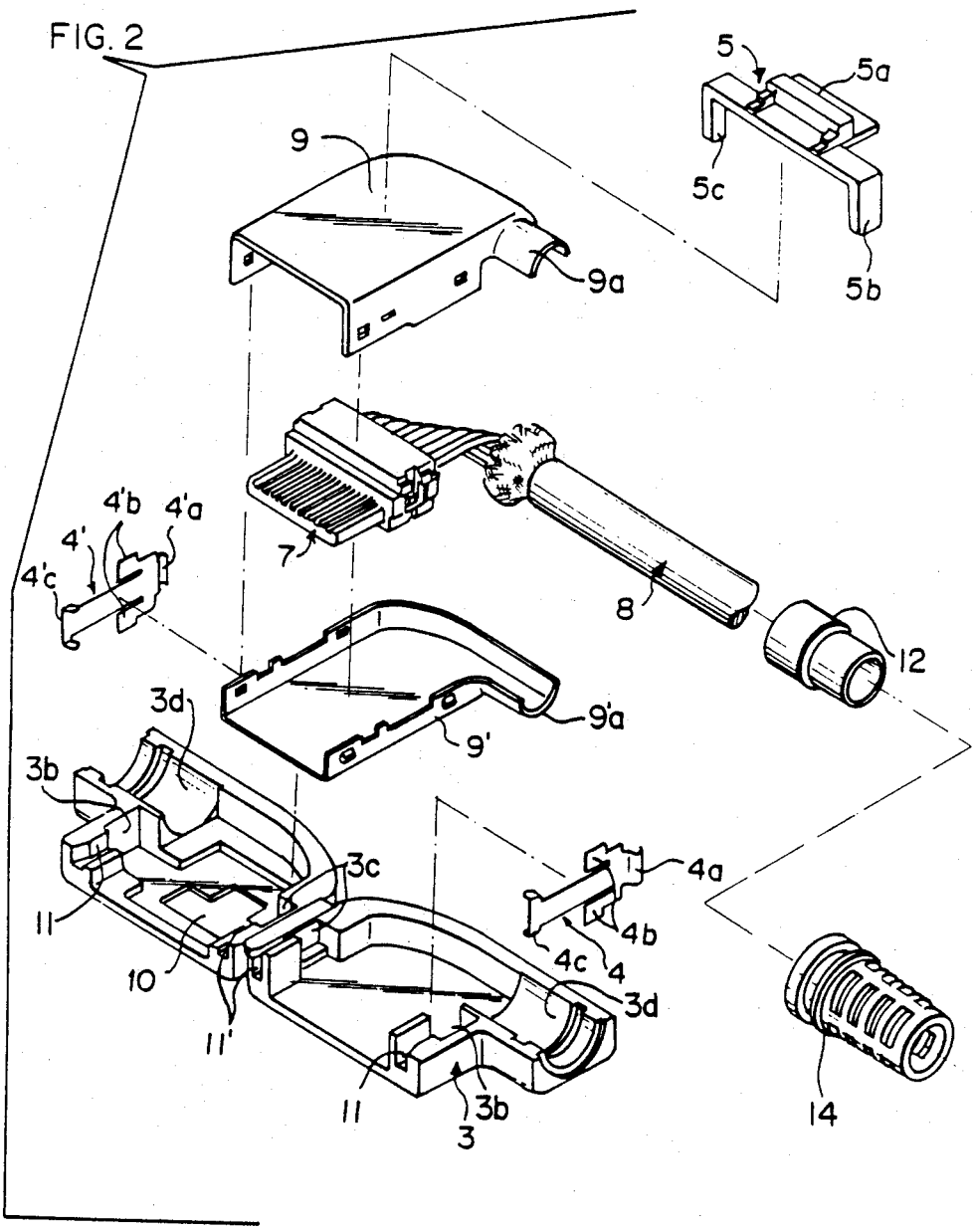
FIG. 2 is perspective exploded view of the parts of the electrical connector of FIG. 1.

Connecting section 2, which protrudes from and is connectable to a complementary electrical connector, is located at a front end of dielectric housing 3 in shielded electrical connector 1. Latch members 4 and 4' which latch with and unlatch or release freely from a connecting section of the complementary connector are located along the sides of the connecting section 2. Latch members 4, 4' are constructed so that they can move from the latch position, shown in FIG. 3A, to the unlatch position, shown in FIG. 3B, by sliding projection 5*a* of operating member 5 which protrudes from one side of housing 3 in the direction indicated by arrow A. Electrical contact assembly 7 includes a dielectric contact-carrying member and electrical contacts and is positioned inside of metal shield members 9, 9'. Each of the contacts of contact assembly 7 is electrically connected to respective electrical wires in electrical cable 8. Thus, the metal shield members 9, 9' cover the contacts and connections of the wires to the contacts thereby forming connecting section 2 as well as shielding the contacts and their connections to the wires.

The multiple electrical contacts, which are electrically connected to the respective wires inside cable 8, are arranged in a prescribed order to form contact assembly 7. Contact assembly 7 is enclosed in the pair of shield members 9, 9', which are latchably connected together and shield connector 1 when it is connected to the complementary connector. A shielding metal braid of cable 8 is positioned onto arcuate sections 9*a*, 9'*a* of shield members 9, 9' and secured thereon by metal ferrule 12. A strain-relief member 14 is disposed over ferrule 12 and they are positioned in arcuate recesses 3d in the sections of housing 3. Connecting section 2 is formed by the front end of the pair of shield members 9, 9' and contact assembly 7. Except for the part which is connecting section 2 at the front end, shield members 9, 9' are enclosed in housing 3, which is molded from a suitable insulating material and includes two sections hingedly connected together. Conventional latching means (not shown) maintain the sections of housing 3 in a closed position on the assembly of contact assembly, shield members, ferrule, strain-relief member, cable and wires. When shield members 9, 9' are enclosed in housing 3, operating member 5 is located on shield member 9 so that projection 5*a* on operating member 5 protrudes through T-shaped opening 10 in one section of housing 3. The pair of latch members 4, 4' are inserted respectively in grooves 11, 11' in a second section of housing 3 and placed so that engaging sections 4*a*, 4'*a* on latching members 4, 4' are engagable by the pair of leg sections 5*b* and 5*c* of operating member 5. Leg sections 5*b*, 5*c* are disposed in channels 3*b*, 3*c* of housing 3 and are movable therein.

When connector 1 is assembled in this manner, the pair of leg sections 5*b* and 5*c* on operating member 5 simultaneously engage engaging sections 4*a*, 4'*a* on each of latch members 4, 4' and latch sections 4*c*, 4'*c* on latch members 4, 4' move simultaneously from a latch position to a release position by engaging projection 5*a* on operating member 5 and sliding it in the direction of arrow A. When projection 5*a* is released, operating member 5 returns to the original position and latch sections 4*c*, 4'*c* of latch members 4, 4' return from the release position to a latch position. This is brought about by the spring action of planar arms 4*b*, 4'*b* of latch members 4, 4' which are disposed in grooves 11, 11' of housing 3.

Figure 3A:
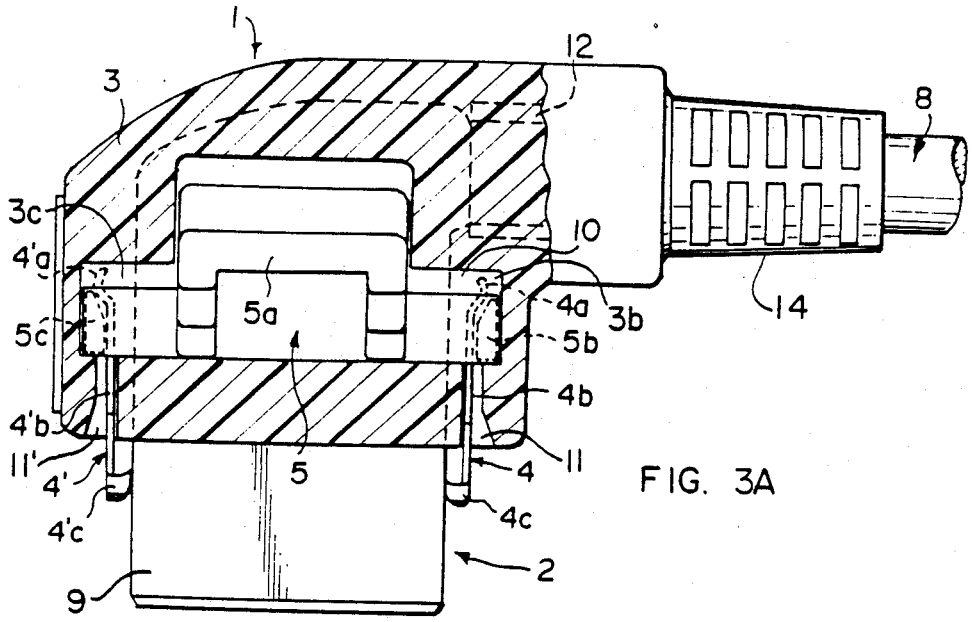
FIGS. 3A and 3B are side elevational views of the connector with part of the housing broken away showing the latch members in a latched position and an unlatched position, respectively.

FIG. 3A shows latch members 4, 4' when they are in a latch position. Arms 4*b*, 4'*b* of latching members 4, 4' are always fixed in grooves 11, 11' of housing 3 and enable the latch members to pivotally move from the latch to unlatch position. As long as there is no external force acting on latch members 4, 4', they are in a latch position. Leg sections 5*b* and 5*c* of operating member 5 are positioned so that they do not engage engaging sections 4*a*, 4'*a* of latch members 4, 4'. Therefore, no external force is exerted on the latch members and they remain in the latch position as indicated in FIG. 3A.

Figure 3B:
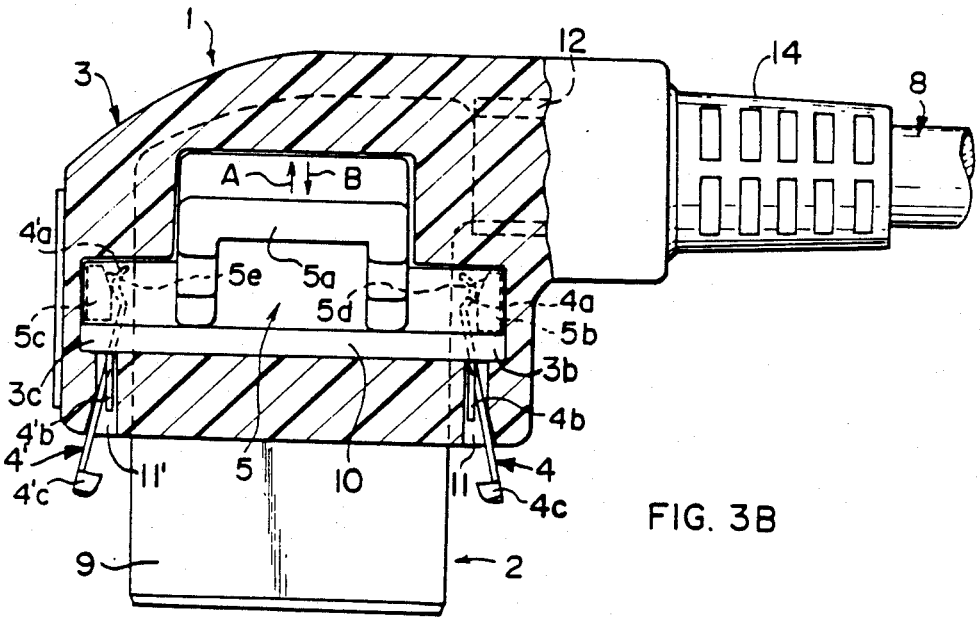

FIG. 3B shows latch members 4, 4' in the release position. When operating member 5 is slid in the direction of arrow A, the pair of leg sections 5*b* and 5*c* on operating member 5 are moved respectively to a position where they engage engaging sections 4*a*, 4'*a* of latch members 4, 4'. This causes the pair of latch members 4, 4' to move from the side of connecting section 2 to the release position where they are released from the latching sections of the complementary connector. Both connectors are disconnectable in this condition. Arms 4*b*, 4'*b* on latch members 4, 4' are fixed in the same position that latching members 4, 4' are located when in the latch position so that latch members 4, 4' are maintained in the latch position by leg sections 5*b* and 5*c* of operating member 5. Therefore, when projection 5*a* of operating member 5 is released, engaging sections 4*a*, 4'*a* of latch members 4, 4' press on tapered surfaces 5*d* and 5*e* of leg sections 5*b* and 5*c* of operating member 5 thereby causing operating member 5 to automatically move in the direction indicated by arrow B whereby latch members 4, 4' return to the latch position as shown in FIG. 3A. Grooves 11, 11' are profiled to enable latch sections 4*c*, 4'*c* to move therein while engaging sections 4*a*, 4'*a* are movable in channels 3*b*, 3*c*.

This invention features simultaneous moving of a pair of latch members from a latch position to a release position by sliding an operating member from a first position to a second position and the automatic returning of the operating member to the first position by the latch members with the operating member maintaining the latch members in a latch position.

As already explained, the shielded connector of this invention provides latch members and an operating means therefor. When the operating means is slid from one position to another position, the two latch members simultaneously move from a latch position to a release position so that the latch members operate together, both latch members can be moved with just one motion and operability is improved. In addition, the two latch members cannot move independently of each other so that both latch members are simultaneously moved accurately in one direction to the release position. In the example given above, after both latch members have been moved from the latch position to the release position by the operating means, both latch members can be automatically returned to the latch position just by releasing the operating means which also maintain the latch members in the latch position. As a result, it is easier to use and operates more efficiently and one need not worry about forgetting to latch it after the complementary connector has been connected to the shielded connector.

I claim:

1. An electrical connector, comprising:

a dielectric housing having an electrical contact assembly as part of a connecting section for electrical connection with a complementary electrical connector;

latch members mounted in said housing and extending along respective sides of said connecting section and including latch sections and engaging sections;

means provided by said housing and said latch members pivotally mounting said latch members in said housing so that said latch members can pivotally move from a latch position in latchable engagement with the complementary connector to a release position so as to be disconnected from the complementary connector; and operating means mounted in said housing for movement from a first position to a second position and including engaging means engageable with said engaging sections of said latch members for simultaneously moving said latch members from the latch position to the release position.

2. An electrical connector as claimed in claim 1, wherein said housing has an opening, and said operating means includes a projection extending through said opening for engagement by an operator to move the operating means from the latch position to the release position.

3. An electrical connector as claimed in claim 1, wherein said engaging means of said operating means are in the form of leg sections for respective engagement with the engaging sections of said latch members.

4. An electrical connector as claimed in claim 1, wherein said pivotally mounting means comprise grooves in said housing and planar arms of said latch members that enable said latch members to move from the latch position to the release position when the engaging means of said operating means engages the engaging sections of said latch members and moves the latch members to the release position when the operating means is moved to the second position thereby placing the latch members under a spring force.

5. An electrical connector as claimed in claim 4, wherein the spring force of said latch members causes said operating means to automatically return to the first position and said latch members to return to said latch position when an operator releases the operating means after being moved to the second position.

6. An electrical connector as claimed in claim 1, wherein said engaging means of said operating means maintain said latch members in said latch position when said operating means is in said first position.

7. An electrical connector as claimed in claim 1, wherein shield members are mounted in said housing enclosing said electrical contact assembly and forming part of said connecting section.

* * * * *